United States Patent [19]

Kasner et al.

[11] Patent Number: 4,844,947

[45] Date of Patent: Jul. 4, 1989

[54] TECHNIQUE FOR THE APPLICATION AND CURE OF PHOTOSENSITIVE PAINTS

[75] Inventors: William H. Kasner, Penn Hills Township, Allegheny County; Roger L. Swensrud, Plum Borough; Daniel P. Soroka, Imperial; Wei-Fang A. Su, Murrysville; Steve A. Wutzke, Penn Hills Township, Allegheny County; Vincent A. Toth, Penn Township, Westmoreland County; Luciano C. Scala, Murrysville, all of Pa.

[73] Assignee: Westinghouse Electric Corp., Pittsburgh, Pa.

[21] Appl. No.: 193,137

[22] Filed: May 5, 1988

Related U.S. Application Data

[63] Continuation of Ser. No. 927,611, Nov. 6, 1986, abandoned.

[51] Int. Cl.[4] ..... B05D 3/06; B05D 5/00; B05D 1/02

[52] U.S. Cl. ..... 427/53.1; 427/272; 427/282; 427/286; 427/424; 427/54.1; 901/43; 118/301

[58] Field of Search ..... 427/53.1, 54.1, 424, 427/272, 282, 286; 118/323, 620, 697

[56] References Cited

U.S. PATENT DOCUMENTS

| | | | |
|---|---|---|---|
| 3,492,072 | 1/1970 | Haun, Jr. | 430/311 |
| 3,529,572 | 9/1970 | Rose | 118/323 |
| 3,991,230 | 11/1976 | Dickie et al. | 427/54.1 |
| 4,269,874 | 5/1981 | Pryor et al. | 427/282 |
| 4,356,216 | 10/1982 | Galley et al. | 421/286 |
| 4,571,149 | 2/1986 | Soroka et al. | 414/750 |
| 4,578,281 | 3/1981 | Ebisawa et al. | 427/272 |

FOREIGN PATENT DOCUMENTS

| | | |
|---|---|---|
| 0081649 | 6/1983 | European Pat. Off. . |
| 1447066 | 8/1976 | United Kingdom . |
| 2009053 | 9/1978 | United Kingdom . |
| 1532962 | 11/1978 | United Kingdom . |

*Primary Examiner*—Norman Morgenstern
*Assistant Examiner*—Margaret Bueker
*Attorney, Agent, or Firm*—G. H. Telfer

[57] ABSTRACT

A system which utilizes a source of ultraviolet radiation to mark a surface or to cure selectively a photosensitive paint applied to a surface. The source of UV light is either a laser or a broadband source and the light is controlled by an aperture and/or a stencil apparatus. The photosensitive paint is applied by a controlled technique as a protective or a decorative coating.

6 Claims, 11 Drawing Sheets

TECHNIQUE FOR THE APPLICATION AND CURE OF PHOTOSENSITIVE PAINTS

This application is a continuation of application Ser. No. 927,611 filed Nov. 6, 1986 now abandoned.

FIELD OF THE INVENTION

The invention relates to a system which employs a source of ultraviolet radiation to cure a photosensitive paint. In one embodiment, this invention provides a system for the application of paint to a surface. In another embodiment, this invention provides a method and apparatus for marking the surface of an article. This invention also provides an automated system which is particularly well suited for the application of decorative markings to automobiles or the like in a manufacturing environment.

BACKGROUND OF THE INVENTION

It has been a long-standing goal in the art to provide as high a degree of automation as possible in the application of protective coatings as well as decorative stripes and markings on a variety of commercial goods. One such example is the automated painting of automobiles through the use of a plurality of robots in sequential work stations. While the application of a protective coating onto an automobile has been substantially automated, attempts to automate the decorative aspects of automobile painting such as pinstriping and monogramming have been beset with problems. The present invention seeks to overcome problems now inherent in many painting applications through the disclosure of a technique for the application and cure of photosensitive paints. While automobiles provide an excellent example of the type of objects which can readily lend themselves to the technique of this invention, it is to be appreciated that any type of product such as an appliance, furniture or even a toy can be painted with and decoratively marked by the technique of this invention.

A contemporary practice in the manufacture of automobiles is the use of decorative trim along various body portions thereof. For example, it is a relatively common practice to provide pinstriping on automobiles. Pinstriping is a process whereby narrow lines of paint for highlighting are placed on certain locations of the car body. In automobile assembly plants, pinstriping is a truly manual process. Generally, there are two methods for the application of pinstriping to automobiles. The use of one application over the other is typically dependent upon the price range and the class of the automobile being manufactured. One technique for pinstriping uses a plastic film which is not unlike a roll of adhesive tape. This plastic film is manually applied to the desired body portion of the automobile. A second technique for more expensive vehicles requires the manual application of paint onto the vehicle. Automobiles on a production line are individually striped at a given work station. Quite often, such work stations cannot handle the volume of automobiles passing therethrough and buffer overflow lines exist whereby a vehicle can be removed from the vehicle production line for pinstriping and then later returned to the production line. The hand-painting process usually requires the vacuum attachment of an alignment guide to the automobile at a desired location. A worker manually manipulates a tool consisting of a knurled wheel with a paint feeder tube along the alignment guide to form the stripe. Obviously, multiple stripes require multiple passes with different tools depending upon both the width and the complexity of the pinstriping design as well as the contour of the automobile body. Because the rollers tend to skid, the tapered ends of a decorative pinstripe are very difficult to form. The alignment tool is difficult to handle and at times can cause scratches on the painted surface of the automobile. The present manual process is extremely labor intensive and should lend itself to automation.

Attempts have been made to automate the heretofore manual paint striping process by simply replacing a workman with a robot. However, nearly all of the problems identified above remained and a greater problem of substantial body damage to the subject automobile due to a misguided robot was also present. It is felt that in order to solve the above-described problems and difficulties associated with pinstriping and detailing of automobiles, an automated, non-contact process is needed.

In order to provide an automatic paint detailer which would eliminate the problems described above, one embodiment of the present system utilizes ultraviolet light radiation curing paint. The existence of pigmented polymerized binders which can be cured by ultraviolet or laser light have been known in the art. One example is taught in U.S. Pat. No. 3,847,771 to McGinniss while other paints which are curable by light having a wavelength in the ultraviolet range are known from U.S. Pat. Nos. 3,364,387; 4,052,280; 4,107,353; and 4,351,708; and from Rybny et al., "New Developments in Ultraviolet Curable Coatings Technology", the contents of which documents are incorporated by reference herein.

It is also known to apply paint to an automobile body by a robotic arm. For example, U.S. Pat. No. 4,539,932 to Vecellio teaches a robotic painting system for electrostatically painting an automobile body that includes a paint module adapted to maintain the automobile body in a stationary position relative to at least two painting robots. Each of the painting robots carries an atomizing device and provides programmed movement about five control axes at a speed which prevents the cone-shaped pattern of atomized paint particles from being distorted due to any gyroscopic affect developed by the atomizing device as it is moved about the control axes. Another example of a vehicle body painting robot can be found in U.S. Pat. No. 4,498,414 to Kiba et al. This patent teaches a vehicle body painting robot for automatically coating a paint on vehicle bodies which are transferred along a conveyor line. The robot includes an arm which is supported on a pedestal rotatably in both vertical and horizontal planes, and a paint applicator for spraying the paint towards a vehicle body delivered to a coating booth. Both of the aforesaid patents are incorporated herein by reference.

It is therefore an object of the present invention to provide a method and an apparatus for the automatic paint detailing of an automobile.

It is a further object of this invention to provide a technique and apparatus in which a robotic arm manipulates a UV light source to direct the light over an area of uncured paint.

It is yet another object of this invention to provide a method and apparatus whereby unique designs and trim detailing such as for example pinstriping and monogramming of vehicles, appliances, furniture and miscellaneous items can be accomplished utilizing a UV-cured paint.

It is still another object of this invention to provide a work station for use in combination with an automobile assembly line for the application of paint detailing and trim to an automobile.

It is another object of the invention to provide a laser marking system of the type employing a stencil whereby a plurality of stencil patterns can be selectively brought into the path of the laser beam for marking the surface of an article with a selected pattern.

It is a further object of the invention to provide a method of marking the surface of an article employing a laser marking system in combination with a paint which is curable upon being irradiated with a laser beam.

SUMMARY OF THE INVENTION

The invention provides an automatic painting system which utilizes ultraviolet light radiation curable paint. The invention also provides for the use of either a laser or a broadband source of ultraviolet light to accomplish the irradiation of the paint. The invention further provides a paint detailer for the application of a predetermined design of paint onto a surface of an automobile or the like. Means are provided for applying a stripe of ultraviolet light radiation curable paint onto a surface. The stripe is of a dimension so as to be both wider and longer than the final desired paint detail design. Means are provided to apply a collimated laser light in the ultraviolet range or light from a broadband source of ultraviolet radiation in a predetermined pattern onto the previously applied stripe of ultraviolet light radiation curable paint. Manipulator means, for example, direct the light onto the paint stripe in order to cure the paint in a predetermined design. The robot arm manipulates a light source or a light beam itself. Means are finally provided to remove the balance of uncured paint, including any over-spray. The uncured paint and over-spray are removed through the application of a solvent selected to be neutral with respect to the cured paint surface. Through this process, fine edge quality of the paint detailing applied to the previously painted body surface is achieved.

The invention further provides a marking system for marking a surface of an article with a pattern selected from a predetermined set of stencil patterns. These stencil patterns can be used in combination with a laser means for generating a laser beam and projecting the beam along a path toward the surface of the article to be marked or with a broadband source of ultraviolet radiation used in combination with appropriate lenses to focus the broadband source. The stencil means comprises a member which is made of a material which is opaque to the laser beam and which has a plurality of differently-shaped openings constituting the predetermined set of patterns, the stencil means is mounted for selectively positioning a respective pattern in the path of the laser beam in order to produce a laser beam on the side of the stencil device remote from the laser means which has a cross-section corresponding to a selected pattern for marking the surface of the article. It is to be appreciated that when used in combination with a broadband source of ultraviolet radiation, the lenses would be appropriately placed on either side of the stencil means as will be described in detail hereinafter below.

In a preferred embodiment, the stencil means is in the form of a rotatable stencil wheel having the plurality of differently-shaped openings spaced apart circumferentially about the wheel, wherein the wheel can be rotated for selectively positioning a respective one of the openings in the path of the light being transmitted therethrough. In a further aspect of this invention, a plurality of stencil wheels are mounted on concentric shafts, with each stencil wheel having a different set of stencil patterns. Each stencil wheel is provided with a neutral opening which essentially allows the light to pass through unimpeded, so that when a pattern from one of the stencil wheels is positioned in the path of the light, the other stencil wheels are rotated to place their neutral opening in the path of the light, allowing the light beam to be shaped according to the selected pattern and to pass through the other stencil wheels unimpeded toward the article to be marked.

BRIEF DESCRIPTION OF THE DRAWINGS

The above, as well as other features and advantages of the present invention can be more clearly appreciated through consideration of the detailed description of the preferred embodiment in conjunction with the several drawings in which.

DETAILED DESCRIPTION OF THE INVENTION

Figure 1:
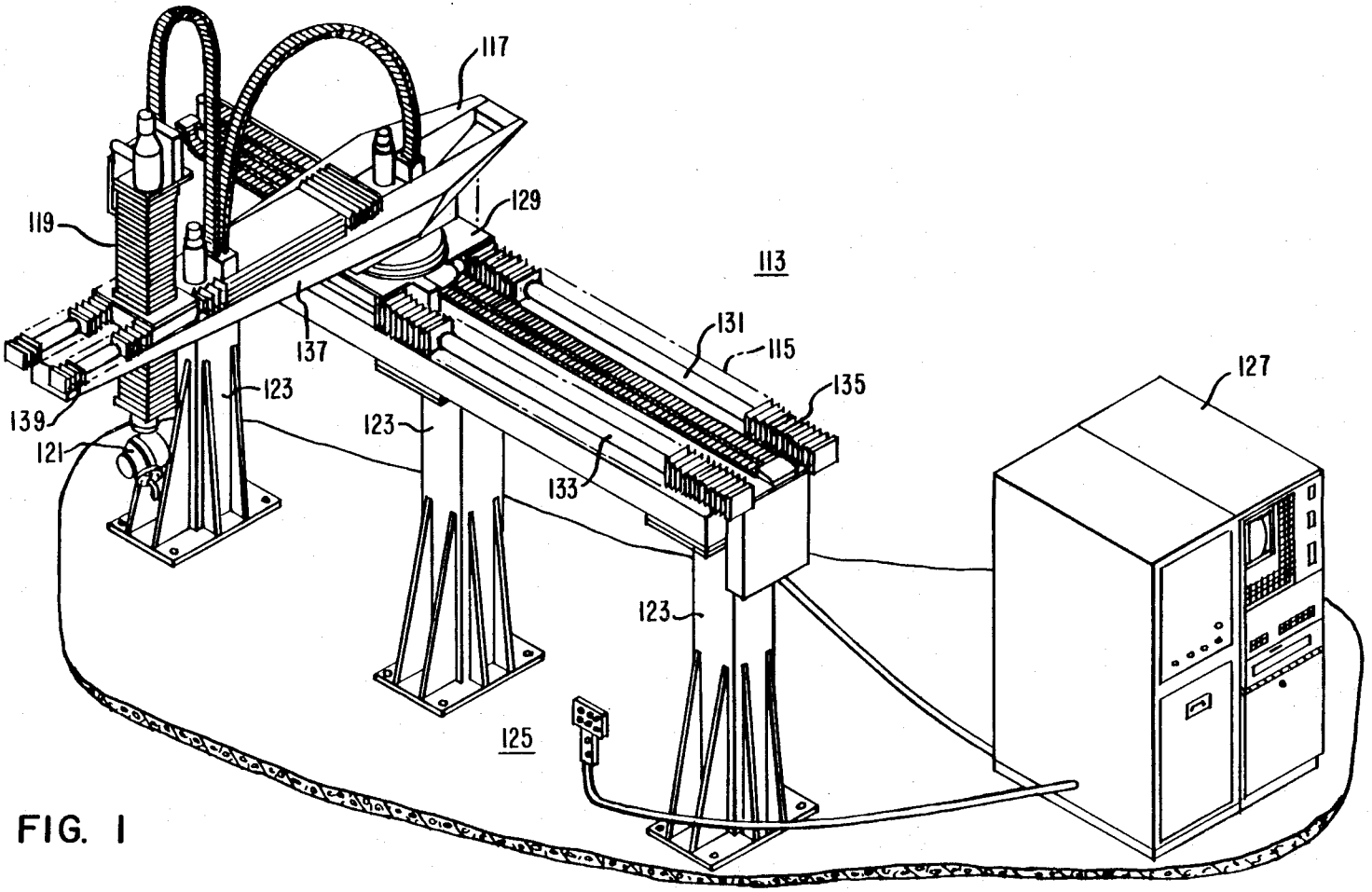
FIG. 1 is an elevational view of a robot utilized according to the paint detailing system and method disclosed herein for applying decorative trim to an automobile on an assembly line.

The method and apparatus of this invention is directed to the marking of a substrate and the application of a protective coating of photosensitive paint and/or paint detailing of a predetermined design onto a substrate. More particularly, the technique of this invention when employed with an automobile body, completely automates the existing manual paint striping process currently used in the automotive industry. The system of this invention can be used to apply onto a substrate or the like any type of detail paint in addition to stripes such as alpha numeric characters and designs. While the preferred embodiment of this invention is directed to the pinstriping and detailing of automobiles, it should be appreciated that the process of this invention can be used for the decoration and/or custom personalization of any other object such as, for example, detailing used in highway road information signs, appliances, etc. While a preferred embodiment of this invention is directed to the detailing of automobiles, it is to be readily appreciated that the techniques and systems disclosed herein can be readily utilized for any of a variety of painting applications.

In one embodiment, the paint detailing system uses ultraviolet light radiation curing paint applied robotically as a broad stripe to base coat prepared automobiles. This broad stripe is wider than the final desired stripe width. A source of ultraviolet light such as an Excimer laser which emits light in the ultraviolet range or a broadband UV source is controlled by a manipulator and the beam from this light source cures the paint only in a desired pattern or location. The balance of the uncured paint, including over-spray, is then removed automatically through the use of a manipulator. Thus, a truly automatic, non-contact, programmable paint detailer can be provided.

Ultraviolet light radiation curing paints are taught in the patent literature, examples of which are U.S. Pat. Nos. 3,847,771; 4,052,280; 4,107,353; and 4,351,708, the contents of which are incorporated herein by reference. The use of a collimated laser light source or a focused broadband UV light source for curing the paint provides the most precise edging and location of the cured paint on a substrate that can be achieved without the use of conventional masking.

The Westinghouse Electric Corporation has developed and made available commercially a general purpose orthogonal axis manipulator system which is disclosed in U.S. Pat. No. 4,571,149 to Daniel P. Soroka et al. This particular manipulator is a gantry-type orthogonal axis manipulator system which includes rack and pinion mechanical drives for the X and Y axis assemblies and a ball screw mechanical drive for the Z axis assembly. This manipulator system employs closed loop DC servo control electrical drives controlled by conventional numerical control techniques. A rotary index feature permits the horizontal rotation of the Y axis assembly which supports the Z axis assembly at the end of travel of the X axis assembly in order to service work zones on either side of the X axis assembly or to permit ease in the maintenance of the end effectors being supported by the Z axis assembly.

This gantry style robot can be used to support an Excimer laser source as will be discussed below or a broadband source of UV light or it can be used in combination with the robotic laser beam delivery system taught by U.S. Pat. No. 4,539,462 which is assigned to the assignee of the present invention and incorporated herein by reference. This robotic laser beam delivery system includes light beam directing apparatus which permits a reflected collimated beam of light such as a laser, to be directed in a path which comprises a plurality of straight segments. Each segment of the beam is associated with the segment of a robot's arm in a fixed spatial relationship. Such a system allows a robot such as the Series 6000 Gantry Robot which is the subject of the aforementioned patent to deliver a laser beam to any point within the working envelope of the robot. Referring now to FIG. 1, there is illustrated a manipulator system 113 comprising three orthogonal axes assemblies consisting of the X axis assembly 115, the Y axis assembly 117, and the Z axis assembly 119. A multiple axis rotary wrist mechanism 121 can be mechanically secured to the Z axis assembly 119 in order to accommodate the appropriate end effectors necessary to accomplish the teachings of this invention.

The operative combination of the X, Y and Z axes assembly is supported in a gantry-type configuration by the vertical support members 123 which are secured to the floor 125 of the working facility. Machine tool-type control of the operation of the manipulator system 113 is implemented by a conventional numerical control console 127 which is available from the Westinghouse Electric Corporation. The orthogonal axis machine tool-type configuration of the X, Y and Z axes assemblies elevated in the gantry configuration results in an optimized work envelope corresponding to the rectangular volume work zone. This gantry configuration of an orthogonal axis manipulator system significantly reduces the number of wrist articulations required to implement the desired work process, and further reduces requirements for auxiliary devices. Pulse width modulated drive for the closed loop DC servo motor arrangements of each axis assembly is provided through the use of conventional drive circuitry located in the drive cabinet portion of the robot control 127. The direct coupled DC servo motor arrangements include a motor-tachometer package and a resolver or encoder. The tachometer provides speed feedback information to the control console while the resolver supplies the control console with position feedback information directly from the drive motor. This produces a highly stable servo response.

The X axis assembly 115 as shown in FIG. 1 consists of a closed cell type of construction which minimizes the torsional deflection of the X axis carriage 129 as it travels along the X axis guidance system, thereby providing the desired system accuracy and repeatability. The X axis guidance system, or way system, includes two, three-inch diameter ground guide rails 131 and 133 which provide maximum rigidity and stiffness for the torsional-type bending modes. The dual rail way system which is supported by the support members 123 further assures a smooth low-friction travel of the X axis carriage in response to the closed loop DC servo control. The X axis carriage 129 is coupled to the guide rails 131 and 133 by linear bearings which are preloaded and sealed in the housings 135 to protect the bearings from dirt. The mechanical drive for the X axis assembly is a rack and pinion mechanism consisting of a rack and pinion shaft which is direct coupled to a DC motor tachometer package.

The Y axis assembly 117, functions as an arm extending perpendicularly from the X axis assembly 115. The Y axis assembly includes a support member assembly 137 and a double rail way arrangement which minimizes the stresses and rotational deflections during the Y axis travel of the Y axis carriage as well as during the positioning of the Z axis assembly within the work zone Z. The guide rails are protected by the covers 139.

The Z axis assembly 119 employs a ball screw mechanism consisting of a ball screw and a fixed nut in combination with a way mechanism consisting of guide rails to transport the Z axis carriage in response to the drive motor-tachometer package motor. The dual rail way mechanism functions similarly to that described above with respect to the X and Y axes. Additional unique features incorporated into the orthogonal axis manipulator system described hereinabove are disclosed in U.S. Pat. No. 4,571,149 which is assigned to the assignee of the present invention and which is incorporated herein by reference.

Figure 2:
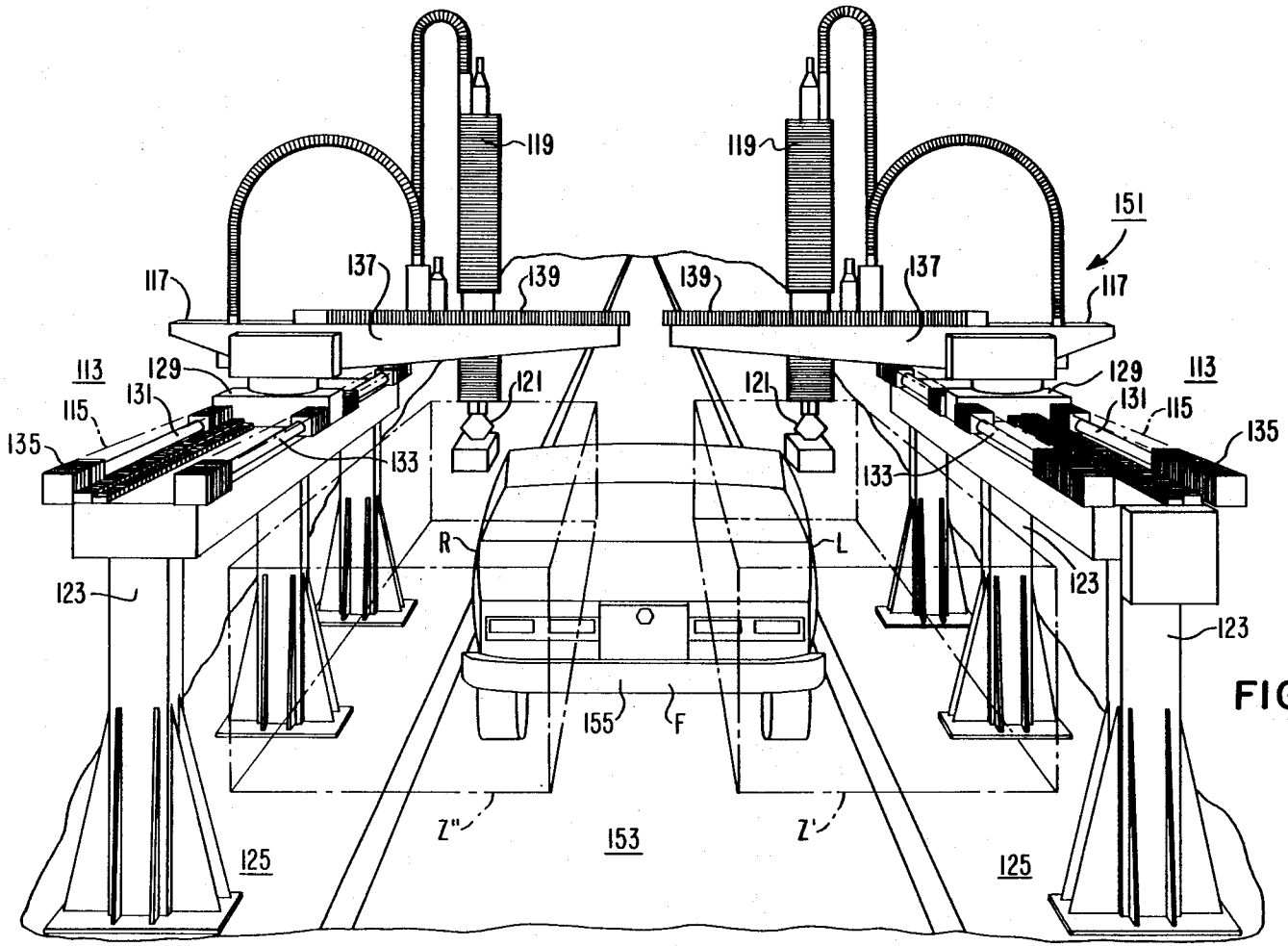
FIG. 2 is an isometric illustration of a paint detailing work cell incorporating the features of this invention.

Turning now to FIG. 2, a work cell generally indicated by the reference character 151, incorporates the teachings of this invention. The work cell 151 is positioned along an assembly line in an automotive manufacturing facility. A conveyor line generally indicated at 153 delivers a vehicle 155 through a series of work stations in which the assembly of the vehicle 155 takes place. It would be reasonable to assume that the paint detailing work cell 151 shown here would be disposed at a location proximate the terminal end of the assembly line. The vehicle 155 is designated as having a front F and a left and right side L and R, respectively. The work cell 151 utilizes two UNIMATE Series 6000 robots generally indicated by the reference character 113. As described in FIG. 2, the orthogonal axis Series 6000 robot 113 has a work zone Z'. In that there are two Series 6000 robots shown, the work zones will be designated Z' and Z''. As the vehicle traverses the work cell 151, the left side L of the vehicle 155 passes through work zone Z', and the right-hand side R of the vehicle 155 passes through the work zone Z''. Thus, in the work cell 151, the X axis 115 of each of the manipulators 113 is disposed in a parallel relationship with respect to the conveyor means 153. Accordingly, the X axis carriage 129 of each of the Series 6000 robots 113, can convey the Y axis assembly 117 at a speed appropriate to accomplish the desired paint detailing on the automobile 155. Means can be provided in the conveyor system 153 to generate speed information of the conveyor 153 through the work cell 151 in order to coordinate the movement of the X axis carriage 129.

Figure 3:
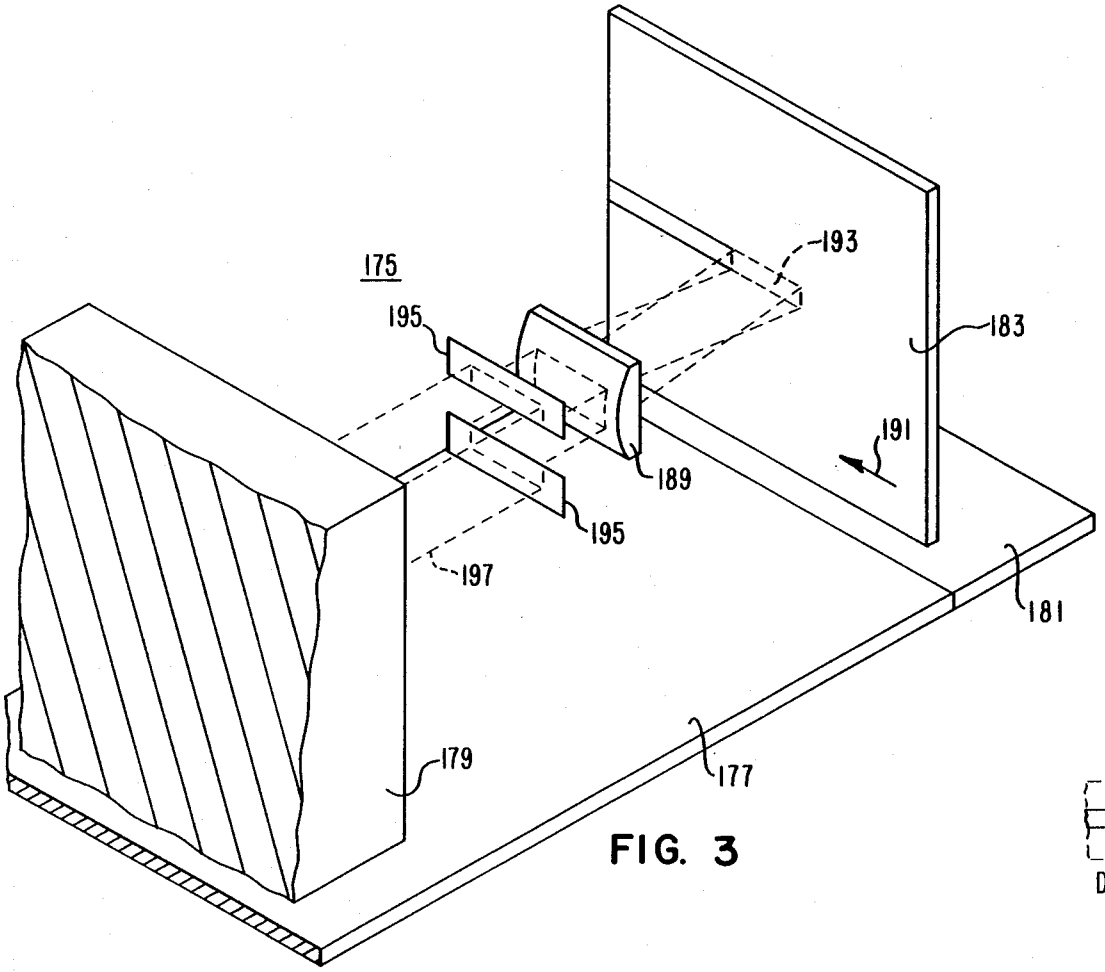
FIG. 3 is an isometric illustration of an optical system used in the preliminary ultraviolet laser curing experiments demonstrating the fundamental principal of this invention.

Turning to FIG. 3, an isometric sketch of an optical system used to experimentally verify the process disclosed herein is generally indicated by the reference character 175. The experimental optical system 175 includes a base member 177 on which is mounted an Excimer laser 179 and a translation stage 181 on which a sample 183 is mounted. The translation stage traveled in the direction indicated by the arrow 191.

The UV curable paints that have been developed at Westinghouse Electric Corporation require radiation in the 250–400 nanometer wavelength range for efficient curing. This radiation can be provided by commercially available UV lamp systems or by an appropriate laser system. Of the commercially available lasers that could be used for this work, Excimer lasers, which radiate at wavelengths ranging from 193 to 350 nanometers, are perhaps the best suited. Excimer lasers have been developed into reliable industrial tools that are available at power levels up to about 300 Watts.

This experimental verification of the instant process of this invention utilized an Excimer xenon fluoride gas laser 179 which has an average 150 watts power, emits ultraviolet radiation at 350 nm wavelength and at pulse repetition rates up to 500 Hz. Aluminum Q-panels were used to investigate the curing conditions of photosensitive paint. One mil thick paint 193 was applied via a gardner's knife. The intensity of the radiation on the Q-panel is determined by the repetition rate, pulse energy, the focus area of the laser and the sample translation rate. In order to obtain a stripe pattern of cured paint on the test panel, two approaches were used. An integrator which can focus the laser beam in different spot sizes was initially utilized however, the radiation intensity was too high to cure paint properly and a decomposition of the photosensitive paint was observed. Then, the stripe pattern was controlled by passing the laser beam through an aperture slit defined by aperture means 195 before the beam 197 struck the test panel. The area exposed to radiation is limited to a defined width which depends on the opening of the aperture means 195 and lens 189. This approach was found to be very effective in obtaining different width stripe patterns. The location of the slit depends on the desired width of the stripe. For any stripe width less than ⅛ inch, the slit has to be located very close to the panel (½ inch) beyond both the focus lens and the light source; for any other widths, the slit can be placed between the light source and focus lens.

Two photosensitive epoxy paints, a white paint and a red paint were used in the study. The white paint is more difficult to cure than the red paint because of the UV absorption of the white pigment, so the curing conditions were established on the white paint first; this was done by first selecting a laser power level. Initially, the laser was set at 290 mJ/pulse and 100 Hz (equivalent to 29 Watts) and the panel was translated at a speed of 1 inch/second (by computer controlled translation stage); under these conditions a degrading effect rather than a curing effect was observed. The laser energy was then lowered to 150 mJ/pulse condition, which was used throughout the experiment. The laser power was quite stable and remained constant during 10 hours of experimentation. After the power choice, the cure of the paint was controlled by the translation speed of the test panel. Several speeds were studied; a touch-dry coating was obtained after one pass exposure at a rate of 0.5 inch/second. Therefore, final curing conditions of 15 watts, 100 Hz and 0.5 inch/second to test paint stripes on the painted panel were established.

Photosensitive paints provide the advantages of fast cure on a heat sensitive substrate such as a painted car body, however, both the degree and type of curing effected in white paints are very sensitive to the thickness of the paint coating to be cured. If the coating is thicker than one mil, only the surface will be cured and will show a wrinkled appearance. After the laser irradiation the paint on the unexposed area was washed away using methanol; the exposed area exhibited high resolution edge characteristics. This experiment demonstrates the concept of controllable ultraviolet curing of paints: a high resolution pattern can be obtained by this unique curing method.

A preliminary estimate of the UV laser operating parameters that would be required for "production line" curing of pin stripes or the like as applied to automobiles can be deduced from the data obtained in these experiments. Excimer lasers operate in a pulsed mode having a very short pulse length, typically 20 to 100 nsec., thereby producing pulses of UV radiation having very high power density. The effects of this high radiant power on the paint samples was observed in initial experiments using the beam integrator. In these tests a single laser pulse produced degradation of the paint surface. From the laser operating parameters for this experiment, we estimate that the laser power density on the paint surface was about $2.5\times10^6$ W/cm$^2$ for a beam size about 1 cm by 1 cm. Other tests conducted using larger beam sizes from the beam integrator suggest that a preliminary upper limit for the power density of the Excimer laser radiation incident on the paint surface should be set at about $0.5\times10^6$ W/cm$^2$. For the Excimer laser of this agreement, this condition corresponds to an energy density of about 40 mJoules/pulse/cm$^2$.

The Excimer laser paint curing tests on the panels were conducted using aperture slits. For these tests the laser was operated at a repetition rate of 100 Hz, delivering an energy of 15 W to the paint surface. The paint sample was translated across the laser beam at a rate of 0.5 in/sec. Using these parameters and the measured cross-sectional area of the laser beam on the paint surface, we estimate that a total laser energy of about 7.5 Joules/cm$^2$ is required to cure the paint samples. For purposes of estimating the laser operating parameters in a production situation, we will assume that a total laser energy of 8 Joules/cm$^2$ is required. It should be noted that this value agrees quite well with the estimated total UV energy required when conventional UV lamps are used as the radiation source. Combining this result with the estimated maximum energy density above shows that a total of about 200 laser pulses are required at each surface area to cure the paint.

An estimate of the curing speed that can be achieved in a production situation can be obtained by extrapolating the performance of the laser and using the above parameters. Operating on the XeF lasing transition, the laser will produce an output energy of 100 W at a pulse rate of 300 Hz. The corresponding pulse energy is 333 mJoule/pulse. This energy is sufficient to irradiate a paint surface area of about 8.3 cm$^2$ without damage to the surface. Operating at a pulse rate of 300 Hz will permit a total area of 12.5 cm$^2$ ($8.3\times300/200=12.5$) to be cured each second. If the pin stripe that is being cured is 0.5 in. wide, a curing speed of approximately 4 in/sec. could be attained. The cross-sectional dimensions of the laser beam that would be used in this case are 0.5 in. by 2.6 in.

Figure 4:
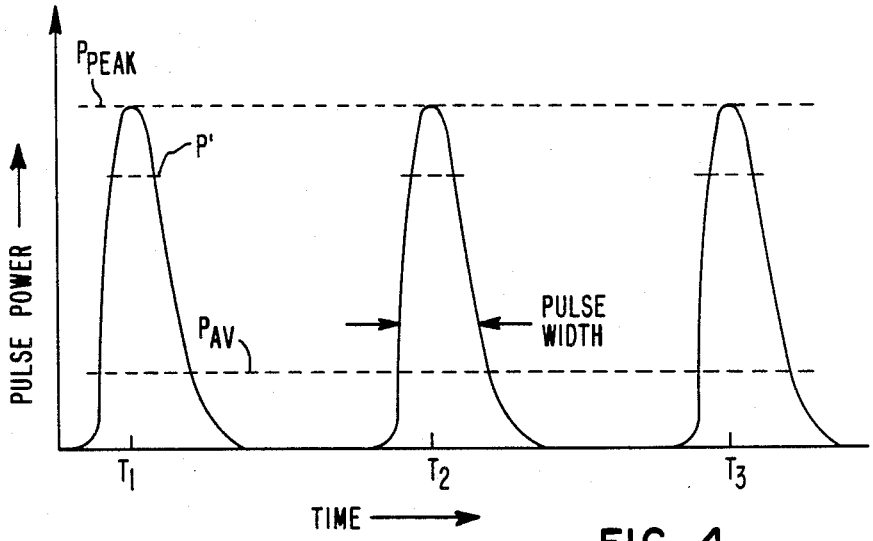
FIG. 4 is a typical Excimer laser pulse profile.

Because of the nature of the electrical discharge involved, Excimer lasers always operate in a pulsed mode, where the pulse width is quite short, normally less than 100 nanoseconds. The sketch in FIG. 4 shows a typical laser pulse train produced by an Excimer laser. This figure plots the pulse power delivered by the laser as a function of time. The time interval between pulses, $T_3$–$T_2$ or $T_2$–$T_1$, can range from very large values, corresponding to single pulse operation, to values of 1/500 second, corresponding to "high repetition rate" operation. The steady state average power produced by the laser is representated by $P_{av}$ in the figure. Values of $P_{av}$ up to 300 watts can be attained using Excimer lasers.

Since the pulse widths of Excimer laser radiation are so short while the intervals between pulses, $T_2$–$T_1$, are relatively long, greater than 2 milliseconds, the laser peak power, $P_{peak}$, and the average power over the pulse width, P′, tend to be very high. Typical values for P′ for an industrial Excimer laser are in the range of 10 to 100 megawatt. Because of this high average peak power during laser radiation pulses, care must be exercised to insure that the irradiated paint surface is not damaged. This damage will occur primarily as a result of overheating of the paint film and the substrate surface. To avoid this surface damage, the laser beam, in most cases, will have to be defocused to reduce to average laser peak power density. Experimental tests indicate that the average laser peak power density should be kept below about 0.5 megawatt/cm$^2$.

Figure 5:
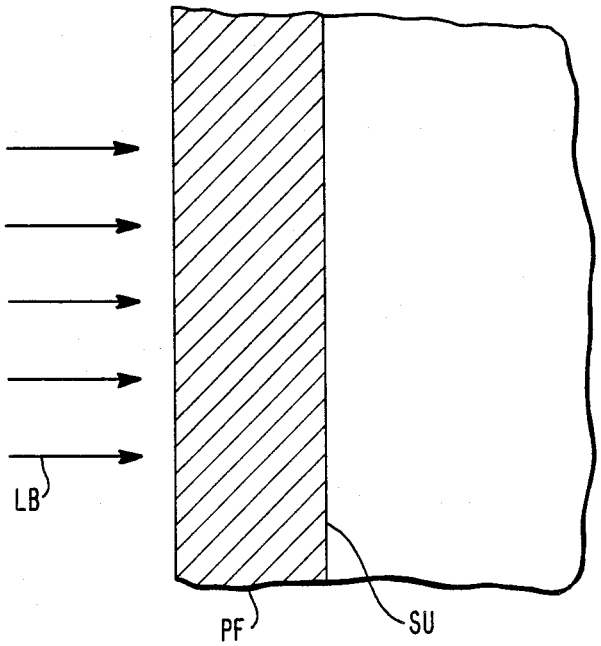
FIG. 5 is a one-dimensional model of a laser beam interacting with a painted metal surface.

Many of the features of the interaction of an Excimer laser beam with a painted surface can be determined from an examination of the one-dimensional model shown schematically in FIG. 5. In this analysis it is assumed that the laser beam LB is uniform with no transverse variation and that the paint film PF is uniform and the surface SU is planer and normal to the incident direction of the laser beam. These conditions are approximately true if:

1. The transverse dimensions of the actual laser beam are much greater than the paint film thickness.

2. The transverse dimensions of the actual laser beam are much greater than the thermal diffusion distance in the base material.

3. The lateral scale size for changes in the surface contour and paint film thickness is much greater than the average paint film thickness.

Another condition that must be satisfied for successful curing of paint by an Excimer laser is that the laser beam must be partially transmitted through the paint film. This condition is necessary so that the photoinitiators that cause the paint to "cure" can be activated by the laser beam photons. Therefore, when a pulsed beam from an Excimer laser is incident on a painted surface, part of the radiation will be absorbed in the paint film and the remainder of the beam will be transmitted to the surface of the base material where it can be reflected back into the paint film, or be absorbed by the base material. That fraction of the laser beam that is reflected from the base material will be partially absorbed by the paint film again and the rest will be transmitted out into space and be lost.

Condition No. 1 above is satisfied in the present situation where the laser beams are several centimeters in diameter and the paint films of interest are typically less than 0.005 inches thick. The second condition above requires consideration of the thermal diffusivity K for the material and the laser pulse width $t_o$. The thermal diffusivity is given by $$K=\frac{k}{\rho_o C} \tag{1}$$

where k is the thermal conductivity, $\rho_o$ is the density and C is the specific heat. For typical base materials, k=0.70 Watt/cm°K., $\rho_o$=7.8 gm/cm$^3$ and C=0.12 cal/gm°K., in which case K=0.18 cm$^2$/sec. The distance d that a thermal wave will advance into such a material during a typical Excimer laser pulse length of 100 nsec. is $$d=(Kt_o)^{\frac{1}{2}}\approx1.3\times10^{-4}\text{ cm}=5.3\times10^{-5}\text{ in.} \tag{2}$$

which easily satisfies the second condition. The third condition should be satisfied over most of the area of the automobile.

As stated above, the average laser peak power density should be kept under 0.5 megawatt/cm$^2$ in order to avoid thermal damage to the paint films. As has been stated, part of the incident laser energy will be absorbed in the paint film itself and part of the energy will be absorbed in the base material. We now want to estimate the increases in temperature that will be experienced in the paint film and in the base material due to the absorbed laser energy. The latter case will be considered first.

For the one-dimensional model shown in FIG. 5 the heat flow equation in the base material becomes $$\frac{\delta^2 T(z,t)}{\delta z^2} - \frac{1}{K}\frac{\delta T(z,t)}{\delta t} = \frac{A(z,t)}{k} \tag{3}$$

where T(z,t) is the temperature as a function of position z and time t, and A(z,t) is the heat production per unit volume per unit time as a function of position and time.

If a constant laser flux $F_o$ is absorbed at the surface, z=0, of the base material and there is no phase change in the material, the solution to Equation (3)

$$T(z,t) = \frac{2\,F_o(Kt)^{\frac{1}{2}}}{k} \times ierfc\left(\frac{z}{2\,(Kt)^{\frac{1}{2}}}\right) \tag{4}$$

(The function ierfc denotes the integral of the complimentary error function erfc.) On the surface, z=0, this solution has a simple parabolic form given by $$T(O,t) = \frac{2F_o}{k}\left(\frac{Kt}{\pi}\right)^{\frac{1}{2}}. \tag{5}$$

The relationship between the absorbed laser flux $F_o$ and the incident laser flux $I_o$ is $$F_o=(1-R(\lambda))I_o=\alpha(\lambda)I_o \tag{6}$$

where R(λ) is the surface reflectivity and α(λ) is the absorptance. Both R(λ) and α(λ) will, in general, be dependent on the wavelength λ of the laser radiation and thus $F_o$ will also depend on wavelength, i.e., $F_o \rightarrow F_o(\lambda)$. Substituting these results into Equation (5) one finally has $$T(O,t) = \frac{2\alpha(\lambda)I_o}{k}\left(\frac{Kt}{\pi}\right)^{\frac{1}{2}} \tag{7}$$

In addition to those conditions already mentioned, the solution presented in Equation (7) assumes that the parameters α(λ), k, and K are constants, independent of both time and temperature. In general, this will not be the case; however, over the range of interest the variations are usually not very large. Furthermore, most pulsed lasers do not produce a constant peak power $F_o(\lambda)$, but a continuously varying output, as shown in FIG. 4. In spite of these limitations the simple analytical solution presented in Equation (7) is quite useful in choosing the appropriate laser operating parameters.

Figure 6:
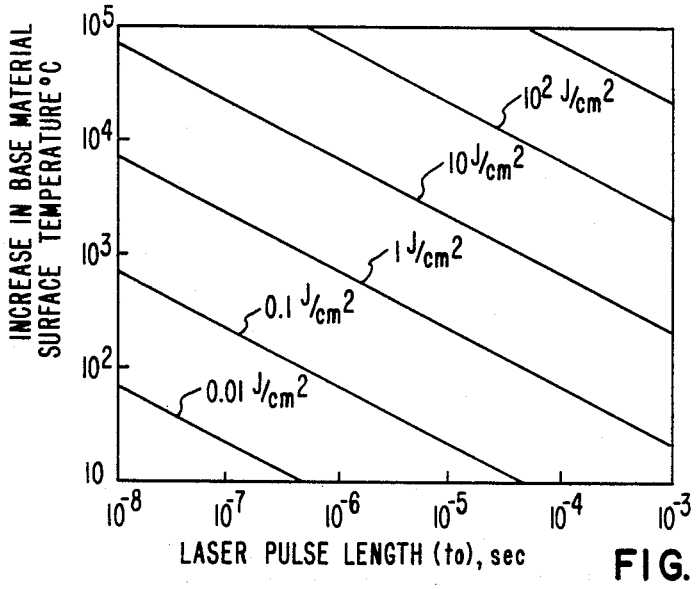
FIG. 6 is a graph representing the estimated base material surface temperature increase as a function of laser pulse length for several different values of laser energy density.

The calculated increases in the base material surface temperature as a function of the incident laser pulse length, obtained using Equation (5), are presented in FIG. 6. The various curves correspond to different assumed values of absorbed laser pulse energy density.

As noted previously, the paint film must be partially transparent to the laser beam in order that the photoinitiators that cause the paint to "cure" can be activated. When the laser propagates through the paint film part of the laser beam energy is absorbed. Part of this absorbed energy serves to activate the photoinitiators and the remainder of the beam energy is converted into heat, which causes the temperature of the paint film to increase. The expected increase in the temperature, $T_p$, of the paint film can be approximately expressed as, $$T_p = \frac{F_p}{C_p \rho_p d_p} \tag{8}$$

where $F_p$ is the absorbed laser flux in the paint film, $C_p$ is the specific heat of the paint material, $\rho_p$ is the density of the paint material and $d_p$ is the thickness of the paint film. For typical UV curable paint materials, $C_p$=0.22 cal/gm°K and $\rho_p$=1.1 gm/cm$^3$. The calculated increases in the paint film temperature as a function of film thicknesses, obtained using Equation (8), are presented in FIG. 7. The various curves correspond to different assumed values of absorbed laser pulse energy density.

Figure 7:
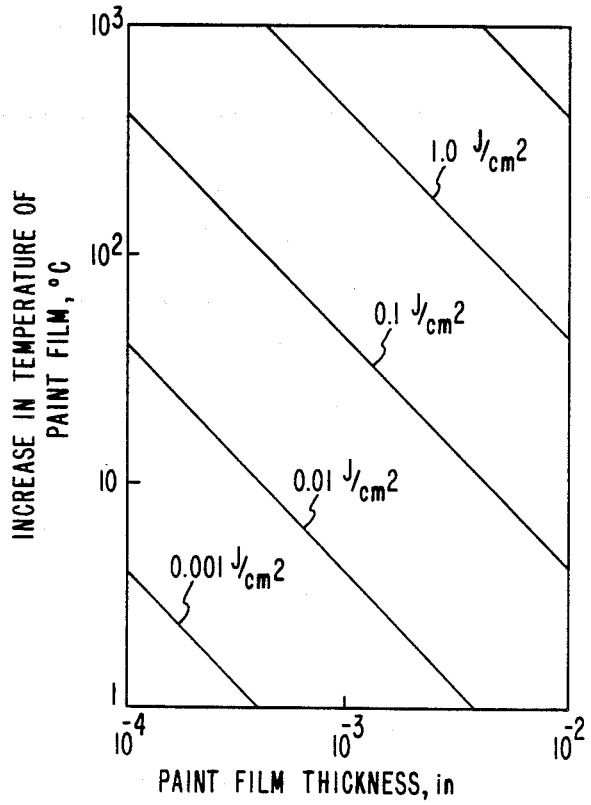
FIG. 7 is a graph illustrating the estimated paint film temperature increase as a function of film thickness for several different values of absorbed laser energy density.

The analysis presented above, along with the graphs of FIGS. 6 and 7, can be used to determine a range of laser operating parameters to use in UV curable painting applications. Once the paint parameters, i.e., paint transmission to the UV radiation, paint film thickness, laser pulse length, etc., have been determined, the appropriate laser operating parameters can be chosen. The optical system used to transport the laser beam to the workpiece can then be adjusted so that the laser energy density at the painted surface will not cause damage to the paint film or to the substrate material.

The experimental laser paint curing studies indicate that laser energy densities of about 0.040 Joules/pulse/cm$^2$ do not cause any paint damage. These studies also show that a total laser energy density of about 7.5 Joules/cm$^2$ is required to cure the paint samples. (Interestingly this value agrees quite well with the estimated total UV energy required when conventional UV lamps are used as the radiation source.) Combining these results, it is noted that a total of 180 to 200 laser pulses are required at each surface area to cure the paint. When an Excimer laser system is used for automobile decorative painting, or pin striping, the motion of the workpiece or the robotic laser beam manipulator must be controlled so that all paint areas to be cured receive the required number of laser pulses to adequately cure the paint.

Figure 8:
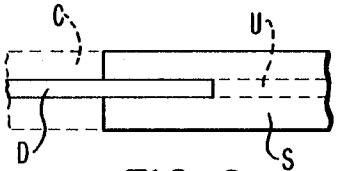
FIG. 8 is a schematical representation of the paint detailing process of this invention.

The paint application and detailing process can be seen in FIG. 8 as it would occur on the left 'L' side of the car 155 as shown in the work zone of FIG. 2. The width of the initially applied strip 'S' is shown to be significantly greater than the desired detail stripe 'D' for illustrative purposes only. The uncured paint need only be applied so as to be wider than the cured detail stripe 'D'. The UV cured portion of the detail 'D' is shown extending into the uncured strip 'S'. The portion of the paint 'S' removed after the UV cure of the detail 'D' is shown in dash-line and indicated as 'C'. The uncured portion of the strip 'S' is shown in dash-line and indicated as 'U'. The end of arm tooling which effects the application, cure and cleaning operations is traveling left to right.

The technique of this invention lends itself to the simplification of the "two-tone" painting of automobiles by providing a masking stripe along the automobile body where the two separate colors meet. This detailing process thus facilitates more advanced multicolor designs on automobiles.

As described above, the particular paint pattern to be fixed onto a surface can be controlled by the manipulation of the laser beam or broadband UV source. According to another aspect of the invention, a method of marking a surface of an article is provided. This marking method can include coating the surface of an article with paint and then irradiating the coated surface of the article in a given pattern with either a laser or a broadband source thus curing the paint contained in the irradiated pattern and leaving the paint outside the irradiated pattern in an uncured state. The technique by which the pattern of light can be controlled and defined is accomplished through a laser marking system which includes a unique stencil wheel design.

Figure 9:
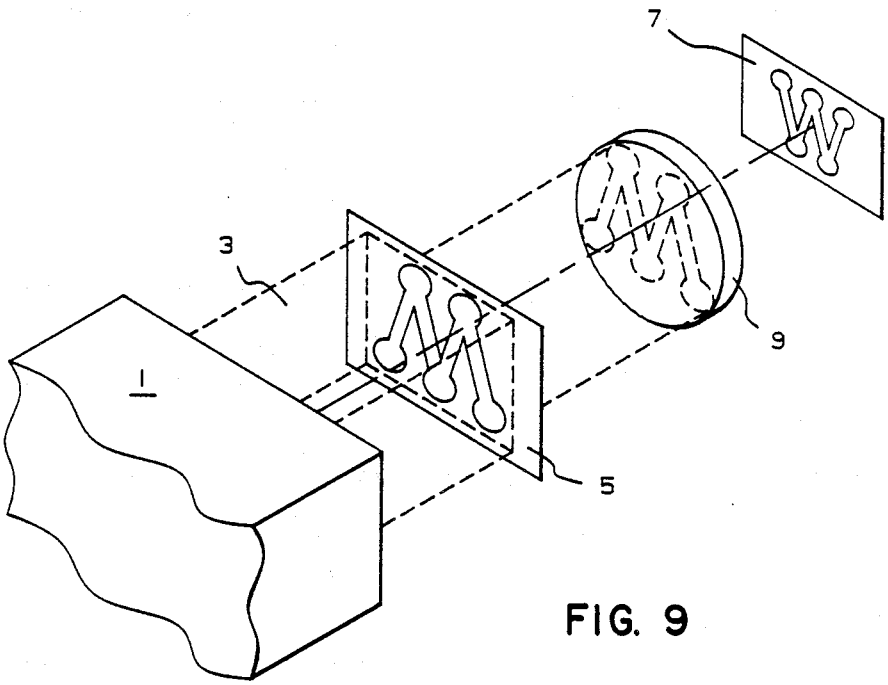
FIG. 9 is a schematic showing a perspective view of a prior art laser marking system employing a stencil.

Referring to FIG. 9 there is shown a prior art arrangement of a laser marking system including a conventional laser 1 for generating and projecting a collimated beam of light, hereinafter referred to as laser beam 3. A stencil 5 made of a material opaque to the laser beam 3 is positioned in the path of the laser beam. Stencil 5 has an opening of a desired shape, which in FIG. 1 is the letter "W", which constitutes a stencil pattern for shaping the cross section of the laser beam which is allowed to pass through the opening and impinge upon the surface 7 of an article to be marked. A lens 9 is located between stencil 5 and surface 7 for the purpose of focusing the laser beam in a known manner. The laser beam marks the surface 7 by causing permanent visible damage to surface 7 in a pattern determined by the shape of the opening in stencil 5. The size of the pattern formed on the surface of the article depends on the separation between the stencil and the article and on the focal length of the lens. Generally, the stencil 5 is mounted in some type of holder (not shown). Each time a different pattern is desired to be formed on the article, the stencil must be physically removed from the holder and a new stencil with another desired pattern is inserted into the holder. The laser marking system of FIG. 9 is thus somewhat clumsy and time consuming to utilize.

Figure 10:
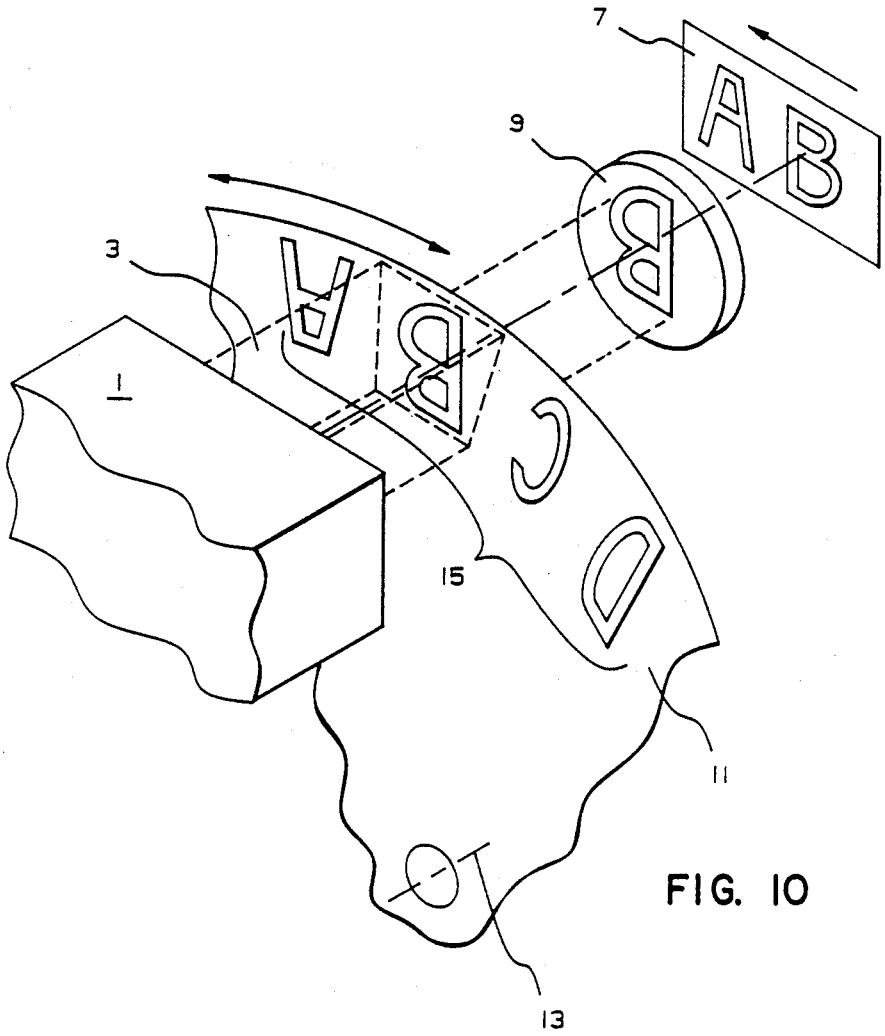
FIG. 10 is a schematic showing a perspective view of a laser marking system used in one embodiment of this invention.

In order to avoid the deficiencies outlined above, a marking system is disclosed which not only extends the capabilities of the paint application system described hereinabove, but lends itself to surface marking of a substrate. FIG. 10 illustrates an embodiment of a laser marking system which includes an arrangement of parts which is generally similar to that illustrated in FIG. 9, with the same reference numerals being used to identify the same parts as shown in FIG. 9. As shown in FIG. 10, a stencil wheel 11 having an axis of rotation 13 and being provided with a plurality of stencil patterns comprised of differently shaped openings 15 arranged in an arc about the circumference of the stencil wheel 11, is used in place of the single stencil 5 employed in the system of FIG. 9. Stencil wheel 11 thus can be rotated for selectively positioning a desired one of the stencil patterns contained on the stencil wheel into the path of the laser beam 3 emanating from laser 1.

As in FIG. 9, the portion of the laser beam allowed to pass through the stencil has a cross section corresponding to the shape of the stencil pattern in the path of the laser beam. The beam so shaped is then focused by lens 9 onto the surface 7 of an article for marking the article in accordance with the selected stencil pattern. In order to mark the article with another stencil pattern, the article may be indexed in one direction or the other, or may remain in the same position if it is desired to superimpose patterns, and the stencil wheel is selectively rotated to position another desired pattern in the path of laser beam 3. As shown in FIG. 10, the letters "A" and "B" have been formed on surface 7 of an article by sequentially positioning the stencil patterns for the letters "A" and "B" of stencil wheel 11 into the path of laser beam 3.

Stencil wheel 11 may be controlled manually for positioning a selected one of the stencil patterns in the path of the laser beam, or may be controlled automatically in the same way as a "daisy-wheel" on a typewriter is controlled for positioning different alphanumeric symbols, such automatic control systems being generally known and forming no part of the present invention.

Stencil wheel 11 may be made of any material that is opaque to a laser beam and which is suitable for the formation of a thin disc, such as copper, aluminum or various types of refractory materials, such as tungsten. Any suitable commercially available laser may be used for the surface marking system. The specifications of the laser will depend somewhat upon the characteristics of the material being marked. However, in general, any suitable $CO_2$ laser, Excimer laser or YAG laser may be used, depending upon particular requirements of the material being marked and the size of the image to be formed on the article. (As should be appreciated from the discussion of lasers with respect to UV curable paint, $CO_2$ and YAG lasers may not be suitable for UV paint curing applications.) Various types of lenses are commercially available for focusing the laser beam. For example a lens made of germanium, gallium arsenide, zinc selenide or various salts such as sodium chloride, potassium chloride or potassium bromide may be used for focusing the laser beam from a $CO_2$ laser. An ordinary glass lens may be used for focusing the beam from a YAG laser. A quartz lens may be used for focusing the beam from an Excimer laser. Although the lens 9 is shown in FIG. 10 as comprising a single lens, more sophisticated, complex lens systems, including a zoom lens, may be used. Additionally, a mirror may be used in place of lens 9 to focus the laser beam.

Figure 11:
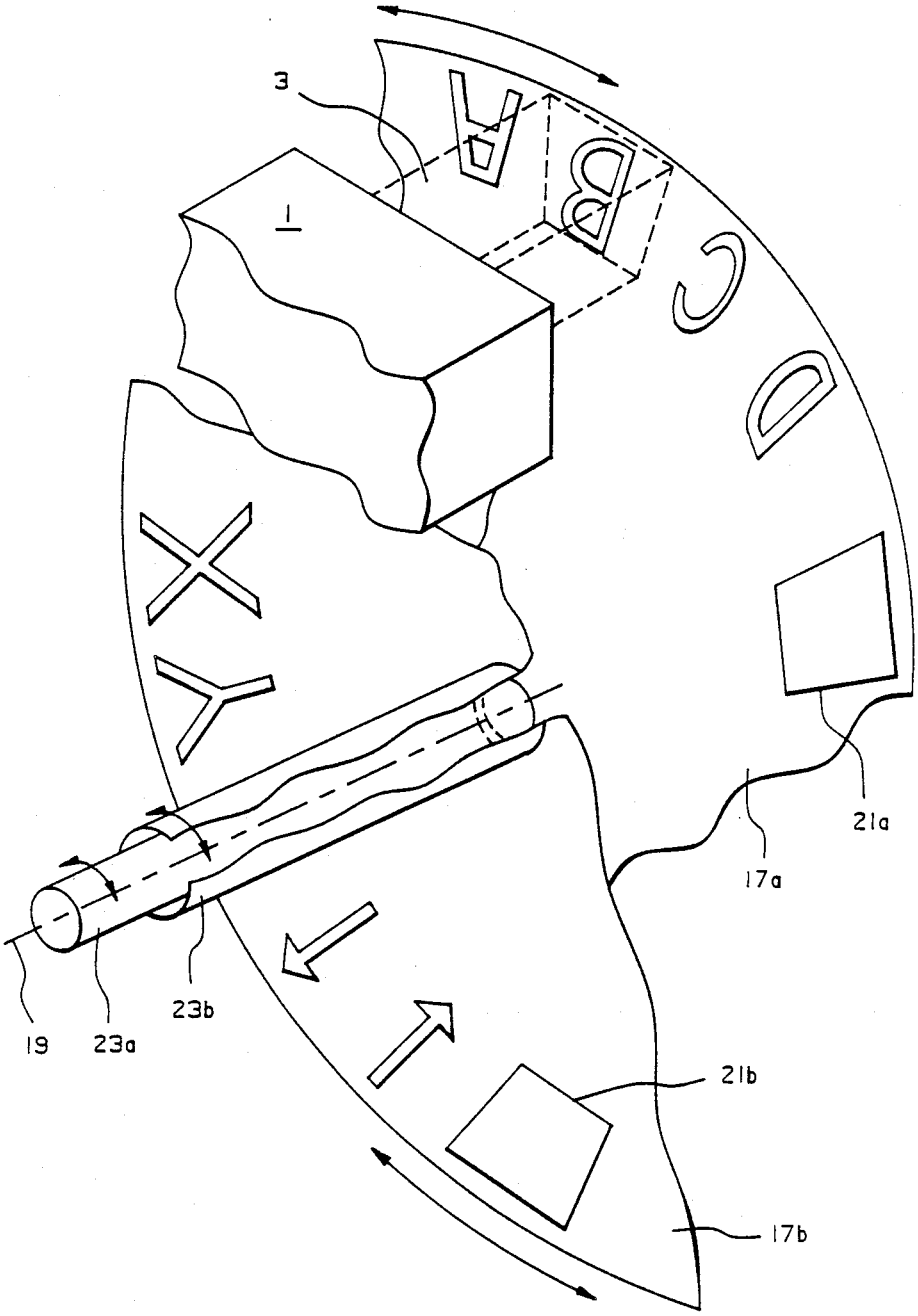
FIG. 11 is a schematic showing a perspective view of an alternative embodiment of the laser marking system illustrated in FIG. 6.

FIG. 11 illustrates an embodiment of a laser marking system according to the invention which employs two stencil wheels **17*a* and 17*b* which are mounted for rotation about axis of rotation 19. Stencil wheels 17*a* and 17*b* are mounted on separate shafts 23*a* and 23*b*, respectively, which are concentric relative to one another, with shaft 23*b* being hollow and enclosing shaft 23*a*. The stencil wheels thus can be separately rotated and controlled independent of each other. Stencil wheels 17*a* and 17*b* each have a neutral opening 21*a* and 21*b*, respectively, each of which essentially corresponds in size with the dimensions of the cross section of the laser beam emanating from laser 1. Thus, with either of the stencil wheels 17*a* and 17*b*** having its neutral position aligned with the path of the laser beam, the other of the stencil wheels can be rotated for selectively positioning one of its stencil patterns in alignment with the laser beam for marking the article with that selected stencil pattern. For convenience, only two stencil wheels have been shown; however, it should be obvious to those skilled in the art that three or more stencil wheels may be employed in the same manner as the two shown in FIG. 11.

Figure 12:
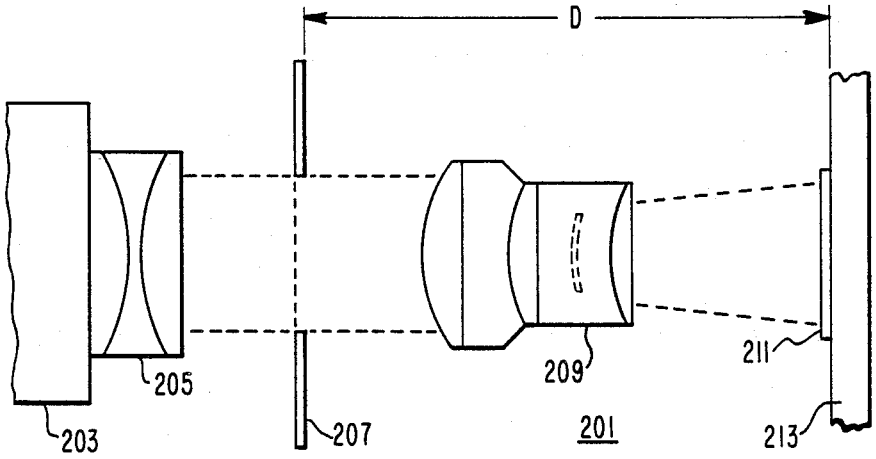
FIG. 12 is a schematic representation of an optical system used in combination with a stencil wheel in which a broadband source of UV light is provided to cure the photosensitive paint.
Figure 13A:
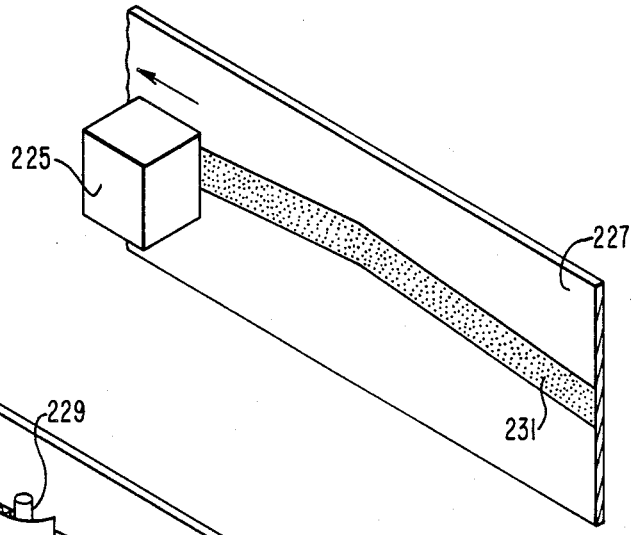
FIGS. 13A and 13B schematically represent the steps in producing a cured decorative design using a computer controlled paint applicator with a broadband UV curing lamp source.
Figure 13B:
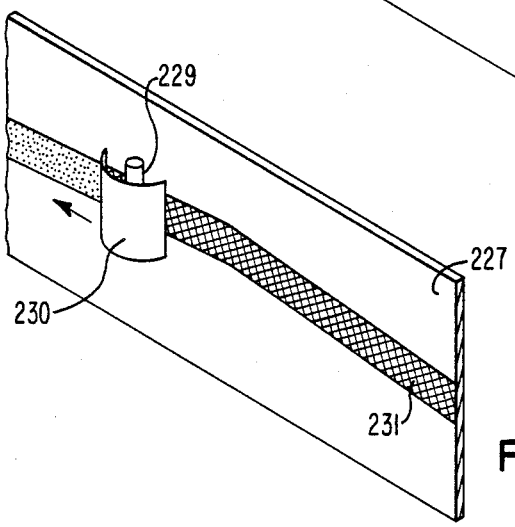

The laser marking system such as that described above can be employed with a paint which is used to coat the surface of an article to be marked and which is curable by radiation in the laser beam. In such a configuration, the laser marking system as shown in FIGS. 10 and 11 would function not unlike the aperture means 195 of FIG. 3 in controlling the portion of the laser beam which is exposed to the painted surface. Moreover, in an alternative embodiment of this invention, a broadband source of UV light with selected optics can be substituted for the laser described above. This alternative embodiment in which the stencil wheel UV laser marking system is modified so that ordinary broadband UV lamps can be used as the irradiation source is illustrated in FIG. 12 and generally indicated by the reference character 201. A conventional broadband UV lamp source 203 is fitted with a suitable collimating lens 205 and is used to irradiate the stencil 207. In all respects, the stencil 207 of FIG. 12 is identical with the stencil means shown in FIGS. 10 and 11 above. The UV radiation that passes through the stencil is intercepted by a zoom lens means 209 and is focused onto the paint film 211 that has been applied to a substrate 213. By using a zoom lens 209, the size of the painted image produced can be easily changed by simply changing the effective focal length of the zoom lens. The zoom lens 209 system used could also be fitted with an automatic focusing mechanism as is done on modern camera equipment. With this feature, the image of the stencil on the paint film can be kept in focus even when the distance D between the stencil means 207 and the paint film 211 is changed. The combined action of the zoom lens and the automatic focus mechanism will provide a wide range of image sizes that can be attained from a single stencil size.

This particular embodiment utilizing a broadband UV source eliminates the need for a laser system. In that the equipment needed for the embodiment utilizing the broadband UV source is relatively small and light weight, the complete optical system of this particular embodiment can be readily incorporated into a robot end effector.

FIGS. 13 through 16 illustrate a paint application technique utilizing UV curable paint that is somewhat similar in philosophy to the techniques presently used in custom paint detailing in that the paint is applied only to the desired location and the paint is then cured. FIGS. 13A and 13B illustrate respectively the steps of the process as applied to pinstriping of automobile panels in which a computer-controlled paint applicator (CCPA) 225 is moved across the substrate 227 to be painted by means of a robotic controlled mechanism. Such a mechanism is not illustrated herein but would be not unlike that illustrated in FIG. 1. As shown in FIG. 13B, a conventional UV curing lamp 229 is shown in an appropriate housing means 230 being moved across the surface of the substrate 227. The UV radiation from the lamp 229 serves to cure the paint 231 applied by the CCPA 225. It should be appreciated that in actual practice, these steps could be performed by moving a compound tool containing both a CCPA 225 and a UV curing lamp and housing 231. Such a tool would apply the paint and then illuminate this paint with the UV curing radiation. The obvious advantages of this proposal are that one does not have to use a laser system for curing and there is no residual uncured paint that has to be removed from the surfaces.

Figure 14:
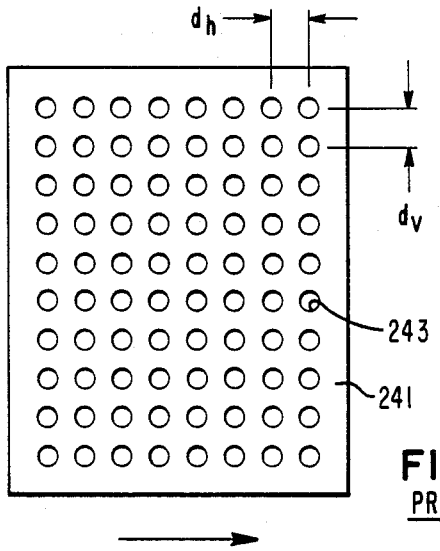
FIG. 14 PRIOR ART
FIG. 14 is a schematic showing of a spray nozzle in a prior art ink jet print head.

The computer controlled paint applicator 225 uses a spray jet system that is not unlike the ink jet systems that are used in computer printers. For example, the "Think-Jet" printer manufactured by Hewlett-Packard is such a device. The head of such an ink jet printer is schematically illustrated in FIG. 14 and indicated by the reference character 241. These heads 241 contain a close packed array of small spray nozzles 243 that can be individually activated by electrical impulses. FIG. 14 shows a prior art representation of such a nozzle array. The alpha-numeric or graphic symbols that are to be printed are formed by energizing the appropriate set of spray nozzles 243. Other examples of such a device are had in U.S. Pat. Nos. 4,356,216; 3,602,193; 2,839,425 and 3,529,572, all of which patents are incorporated herein by reference.

In providing decorative detail to an automobile for example, the appropriate array of spray nozzles needed to produce the desired width of the pinstripe are energized and the CCPA is moved along the substrate as required. If the pinstriped width needs to be modified, some nozzles can be activated or deactivated as required.

Figure 15:
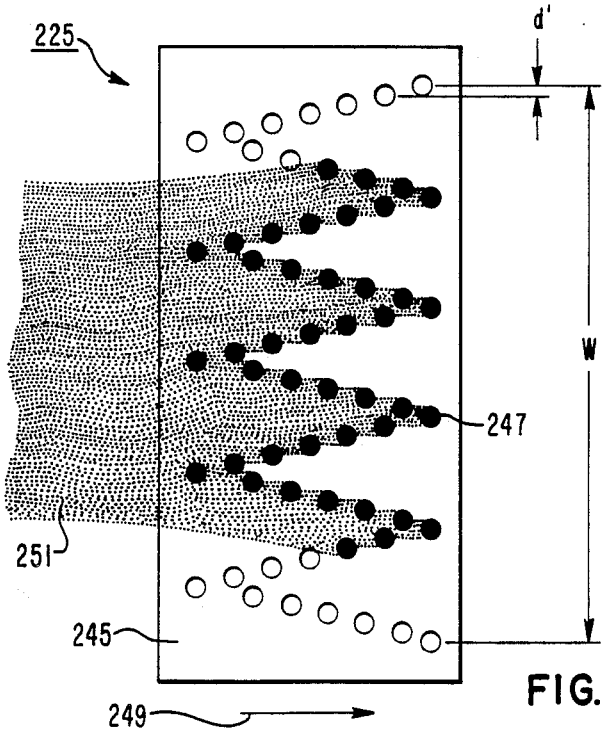
FIG. 15 is a schematic representation of a spray nozzle suitable for use in a computer controlled paint application system using UV curable paint.
Figure 16A:
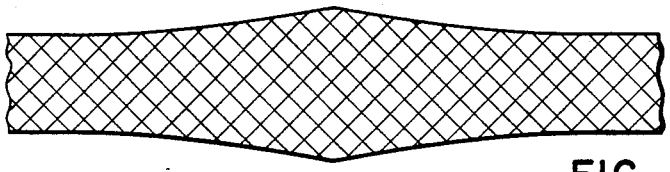
FIGS. 16A and 16B represent examples of pinstriped designs that can be produced by the use of the spray nozzle illustrated in FIG. 15.
Figure 16B:
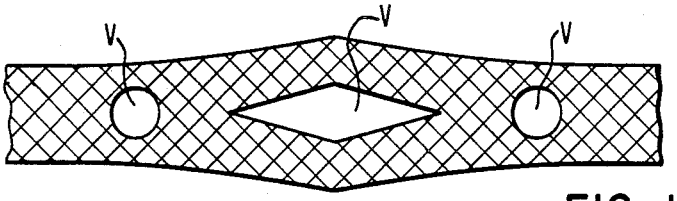

An important quality of pinstriping or for that matter, any decorative detailing that must be achieved is a smooth non-wavering edge. To obtain this feature, the individual spray nozzles 243 must be relatively close together. The minimum spacing represented by $d_h$ and $d_v$ in FIG. 14 that can be achieved is in the range of 0.005 to 0.010 inch. This spacing may be too large to produce the edge quality necessary for decorative marking. However, if the nozzle array is moved in a direction that makes a small angle with rows of nozzles as shown in FIG. 15, the edge regularity can be controlled more closely. In FIG. 15, the nozzle head 245 is shown to have a plurality of spray nozzles 247 that is well suited for use in applying decorative striping. As can be seen there, it is clearly evident that the edges of the stripe can be carefully controlled since the width increment d' can be much smaller than $d_h$ or $d_v$ as shown in the arrangement of the spray nozzles in FIG. 14. The CCPA 225 of FIG. 14 is shown in an operational mode. The solid circles represent spray nozzles 247 that are energized. The direction of motion of the CCPA is as shown in the figure by the arrow 249. A stripe of paint 251 is shown. From this figure, it is clear that the width of the stripe 251 can be altered by changing the number and distribution of the spray nozzles 247 that are energized. The width of the stripe can be changed by increments as small as d' which may have a dimension of between about 0.001 to 0.002 inch. The overall position of the stripe in a direction perpendicular to the motion of the CCPA can be altered by gross motion of the CCPA by the robotic mechanism as shown in FIG. 1. The position of the stripe can also be changed by energizing a different set of spray nozzles. This motion which can be as small as d' if desired may provide a means for fine control of the stripe position that is superior to that achieved with robot control mechanism and as such represents an important improvement to the art of decorative striping. The CCPA 225 can be used to generate more complex striped designs than can be generated by other means. As can be seen in FIG. 16A and B, pinstripes can be generated to have solid patterns with varying thickness as shown in 16A or complex stripes with shapes or voids V therein which permit the underlying color to be viewed through the stripe. Obviously, various open designs can be created utilizing this nozzle by simply changing the configuration of the spray nozzles that are energized as the CCPA is translated along the length of a substrate.

By way of additional example, the paint application system described herein can be used to produce a full color picture or mural. To accomplish this task, the CCPA would be rastered over the surface area to be painted. In the first pass of the CCPA, one of the three primary colors required to make a colored picture would be deposited on the surface. This paint would be cured using UV curing lamps as disclosed above. The CCPA would be rastered over the surface a second time, depositing the second primary color. This second color would then be cured. A third primary color would then be applied over the other two colors following the same procedure. The result of this process would be a full color print of the picture. This entire process is similar in many respects to the process of making colored lithographic prints, except that in the latter case, conventional printing techniques are employed. In the color painting process described herein, it would be desirable to use paints that are semi-transparent so that the three primary colors would all show. An alternative technique that could be used in this application would involve combining the three CCPAs for the primary colors into a compound tool that moves across the surface, depositing all three colors in a single pass. A UV lamp attached to this tool would serve to cure the paint on the surface thus producing a full color picture. It should be appreciated that for broad area applications, one might employ a wide CCPA having a plurality of nozzles therein in order to minimize the number of raster skins required. One embodiment of the CCPA might be a long linear device, somewhat analogous to the computer line printers, for applying paint patterns at a higher rate of speed. A CCPA of this sort could be used to paint an entire picture with a single pass thereby eliminating the need to use a raster scan process.

Figure 17:
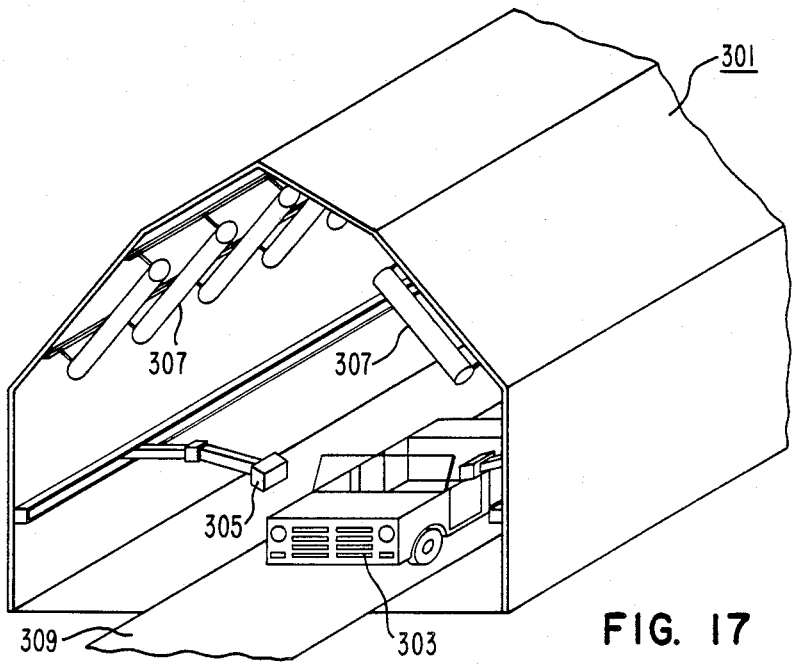
FIG. 17 is a schematic representation of an automated UV curable paint application and curing station for use with an automobile.

Turning now to FIG. 17, there is shown a work cell like structure 301 which can be utilized to coat an object such as an automobile, airplane, appliance or the like 303, with one or more colors of UV curable paint. The structure also includes means 305 to accomplish the application of the UV paint. Such a complete cell as shown herein could be used for example to provide the camouflage paint finish for a military vehicle using the paint application techniques described herein. Moreover, a pattern of broadband UV light sources 307 is disposed about the cell to cure the UV paint deposited on the object being conveyed therethrough. In the work cell structure 301, the paint application means 305 and light sources 307 can be mounted so that the relative motion between the paint source and the object 303 to be painted is provided by a conveyor means 309. Thus the marking technology of this application can be accomplished on a moving or a stationary object.

What has been described is a technique for the application and curing of a photosensitive paint by means of a light source providing the appropriate wavelength of light. This technique can be utilized for such applications as the coating of an entire object, decorative marking and striping and the disposition of alpha numeric characters onto a surface.

What is claimed is:

1. A method of painting a surface of an article, having a changing contour over portions thereof, comprising:

coating at least a portion of the surface of the article with a paint which is curable upon being irradiated with light having a given wavelength;

irradiating only a portion of the coated surface of the article, in a desired pattern, with a laser beam having a wavelength in said given range to cure the paint contained in the irradiated pattern and leaving the paint outside the irradiated pattern in an uncured state;

said irradiating being performed while effecting transverse relative motion between the laser beam and the coated surface and shaping a cross-section of the laser beam into a desired pattern by passing the laser beam through optical shaping means before impingement on the coated surface, said optical shaping means being variable during the irradiating to modify the desired pattern, said optical shaping means also maintaining transverse dimensions of the laser beam received at the coated surface greater than both the paint thickness and the article's thermal diffusion distance; and, removing the uncured paint from the surface of the article.

2. A method according to claim 1, wherein said shaping step includes passing the beam through an opening in an opaque member, the opening having the shape of the desired pattern.

3. A method according to claim 2, wherein the opaque member comprises a stencil in the form of a rotatable disc having a plurality of openings each forming a different pattern, the disc being positioned so that the openings can be selectively placed in the path of the beam by rotating the disc, and said shaping step includes rotating the disc to position a selected opening in the path of the laser beam.

4. A method for painting a predetermined design of a first dimension onto a surface comprising the steps of:

applying a coating of ultraviolet light radiation curing paint to the surface, said applied coating being of a second dimension which is larger than and overlays the predetermined design;

applying a light in a broadband ultraviolet range through a stencil to produce a predetermined pattern consistent with the predetermined design onto the applied coating of paint in order to cure the paint in the predetermined design while leaving uncured paint on the surface, with the applying of the light including focusing the predetermined pattern of light onto the applied coating of paint by a zoom lens means whereby the size of the predetermined pattern of light can be changed by changing the zoom lens means effective focal length; and removing the balance of uncured paint, including over-spray through the application of a solvent selected to be neutral with respect to the cured paint surface, whereby the predetermined design is now represented by cured paint.

5. A method of paint detailing a surface of an automobile, comprising the steps of:

applying a coating of ultraviolet light radiation curing paint onto said surface by means of a computer controlled paint applicator means having a close packed array of spray nozzle means which are selectively activated or deactivated to spray paint therefrom onto the surface, said applied coating being of a dimension corresponding to a final desired predetermined design;

during said applying, moving said surface in a direction that is transverse relative to the spray paint being applied from said nozzle means, said array of spray nozzle means including individual nozzle means having a center to center spacing perpendicular to the direction of relative movement of the surface that is substantially smaller than a diameter of the individual nozzle means; and, applying a light in an ultraviolet range to the coating in order to cure the applied coating of paint.

6. The method according to claim 5 wherein the paint detailing of the surface of an automobile further includes the steps of applying at least a second coating of ultraviolet light radiation curing paint of a color different from the initially applied paint onto the surface, said second coating being of a dimension corresponding to a final desired predetermined design; and applying the light in an ultraviolet range to the coating in order to cure the second applied coating of paint.

* * * * *